US008806788B1

(12) United States Patent
Hu

(10) Patent No.: US 8,806,788 B1
(45) Date of Patent: Aug. 19, 2014

(54) MAGAZINE LOCKING STRUCTURE FOR GUN

(71) Applicant: Shih-Che Hu, Tainan (TW)

(72) Inventor: Shih-Che Hu, Tainan (TW)

( * ) Notice: Subject to any disclaimer, the term of this patent is extended or adjusted under 35 U.S.C. 154(b) by 0 days.

(21) Appl. No.: 13/958,635

(22) Filed: Aug. 5, 2013

(51) Int. Cl.
*F41A 9/61* (2006.01)
*F41A 17/38* (2006.01)

(52) U.S. Cl.
CPC .. *F41A 9/61* (2013.01); *F41A 17/38* (2013.01)
USPC ..... 42/6

(58) Field of Classification Search
CPC ..... F41A 17/38
USPC ..... 42/6, 7, 71.01; 89/197
See application file for complete search history.

(56) References Cited

U.S. PATENT DOCUMENTS 1,344,991 A * 6/1920 Cunningham ..... 89/144
4,562,659 A * 1/1986 Neta ..... 42/75.03
4,944,109 A * 7/1990 Zedrosser ..... 42/71.01
5,519,954 A * 5/1996 Garrett ..... 42/6

* cited by examiner

*Primary Examiner* — Reginald Tillman, Jr.
(74) *Attorney, Agent, or Firm* — Raymond Y. Chan; David and Raymond Patent Firm

(57) ABSTRACT

A magazine locking structure used in a gun is disclosed to include a locking member mounted in the main gun body behind the grip and pressable directly to unlock the magazine from the main gun body, a spring-loaded button set mounted in the main gun body in front of the grip, and a link coupled between the spring-loaded button set and the locking member for moving the locking member to lock or unlock the magazine when the user pushes a press block to shift an actuation rod leftward or rightward in moving a side lug of the link via a push block that is supported between two second spring members.

7 Claims, 8 Drawing Sheets

MAGAZINE LOCKING STRUCTURE FOR GUN

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to gun technology, and more particularly to a magazine locking structure for gun, which allows the user to unlock the magazine from the gun by either a front operating mode or a rear operating mode.

2. Description of Related Arts

The magazine 10 of a big gun (see FIG. 1) is mounted at the main gun body "a" in front of the grip 20, and detachably secured to the main gun body "a" by a magazine locking device "b". The magazine locking device "b" comprises a locking member 30 and a spring member 303. The locking member 30 is mounted at one lateral side of the main gun body "a", comprising a press rod portion 301 and a locking rod portion 302 connected at right angles. The press rod portion 301 is supported on the spring member 303 that is mounted within the main gun body "a". Normally, the press rod portion 301 is not pressed by an external force, and the locking rod portion 302 is help in a retaining groove 101 to lock the magazine 10 to the main gun body "a". Once the press rod portion 301 is pressed by a user, the locking rod portion 302 is immediately forced out of the retaining groove 101 by the spring member 303, allowing removal of the magazine 10 from the main gun body "a".

Subject to gun function design considerations, a gun can be configured having the magazine 10 mounted in the main gun body "a" at a rear side relative to the grip 20 (see FIG. 2). The magazine 10 can be detached from the main gun body "a" in the same manner as shown in FIG. 1. However, this prior art gun design has drawbacks as follows:

1. The magazine 10 is disposed near the rear gun butt 40 and kept near the user's body. Because the locking member 30 is not in the front sightline, the other hand (normally the left hand) of the user that is not holding the grip 20 cannot press the press rod portion 301 easily and rapidly when going to replace the magazine 10, complicating the magazine 10 mounting and dismounting procedures.

2. When going to replace the magazine 10, the user needs to put down the gun, and then pick up the gun for firing after replacement of the magazine 10. The application of this design of gun causes inconvenience and lacks mobility.

SUMMARY OF THE PRESENT INVENTION

The present invention has been accomplished under the circumstances in view. It is one object of the present invention to provide a magazine locking structure for gun, which eliminates the magazine replacement problems of prior art designs and facilitates mounting and dismounting of the magazine.

To achieve this and other objects of the present invention, a magazine locking structure of the present invention is mounted in a gun. The gun comprises a main gun body equipped with a grip, and a magazine detachably mounted in the main gun body at a rear side relative to the grip. The magazine defines a retaining groove. The magazine locking structure comprises a locking member mounted at one lateral side of the main gun body adjacent to the magazine, and a first spring member supporting the locking member. The locking member has two opposite ends thereof respectively terminating in a press rod portion and a locking rod portion. The press rod portion has an inner side thereof connected to and supported on the first spring member in such a manner that the locking rod portion is held in the retaining groove of the magazine to lock the magazine to the main gun body when the press rod portion receives no pressure; the locking rod portion is forced out of the retaining groove of the magazine to unlock the magazine from the main gun body when the press rod portion is pressed by an external force. The magazine locking structure further comprises a spring-loaded button set and a link. The spring-loaded button set and the link are mounted within the main gun body. The spring-loaded button set comprises a press block and an actuation rod. The press block is transversely inserted through the main gun body and alternatively movable leftward and rightward relative to the main gun body. The actuation rod is mounted in the press block, and movable by the press block to carry the link alternatively forward and backward. The link comprises a rear lug located at a rear side thereof and abutted at an inner side of the locking member. The rear lug is adapted to force the locking rod portion of the locking member out of the retaining groove of the magazine, and to further unlock the magazine from the main gun body when the actuation rod is forced to carry the link forward, and to let the locking rod portion of the locking member be forced into the retaining groove of the magazine and to further lock the magazine to the main gun body when the actuation rod is forced to carry the link backward.

Further, the spring-loaded button set is mounted in the main gun body at a front side relative to the grip. The press block comprises an oblique left slot and an oblique right slot disposed in a symmetric manner and linked to each other. The actuation rod is accommodated in between the oblique left slot and the oblique right slot when the press block is not pressed, and is forced into the oblique right slot when the press block is pushed leftward relative to the main gun body by an external force, or into the oblique left slot when the press block is pushed rightward relative to the main gun body by an external force.

Preferably, the spring-loaded button set further comprises a push block and two second spring members. The push block has a front end thereof fixedly connected to the press block. The two second spring members are respectively mounted at opposing left side and right side of the push block, and adapted to push the press block back to the position where the actuation rod is kept in between the oblique left slot and the oblique right slot after the press block having been pushed leftward or rightward relative to the main gun body.

Further, the actuation rod comprises a top extension portion upwardly extended out of the press block. The link further comprises a side lug transversely extended from one side of a front end thereof and fixedly connected to the top extension portion of the actuation rod.

Preferably, the link further comprises an oblong horizontal slot located at a middle part thereof and horizontally slidably coupled to a guide rod of the main gun body.

Preferably, the press block further comprises a locating groove located at a rear side thereof. The push block has a front end thereof fixedly connected to the locating groove of the press block.

Preferably, the locking member further comprises a beveled guide edge located at an inner side of the locking rod portion and abutted against the rear lug of the link so that the locking rod portion of the locking member is movable out of the retaining groove of the magazine by the rear lug when the actuation rod carry the link forward.

In conclusion, the invention provides a magazine locking structure for use in a gun where the magazine is mounted at the main gun body at a rear side relative to the grip. By means of the functioning of a spring-loaded button set and the functioning of a link that is coupled between the spring-loaded button set and a locking member of the magazine locking structure, the magazine can be conveniently unlocked from the main gun body either by pressing the rear-sided locking member or pushing a front-sided push block of the magazine locking structure.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
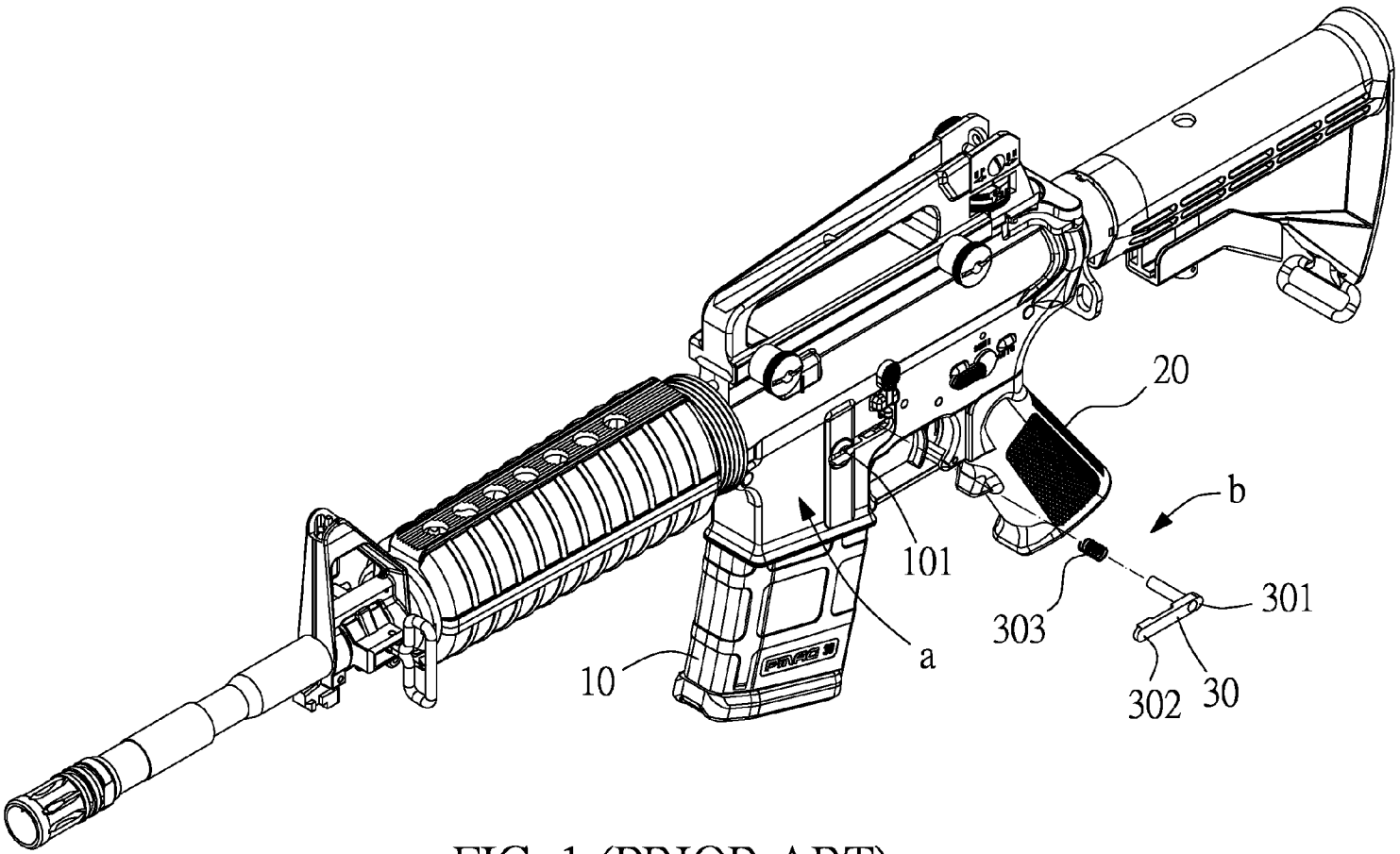
FIG. 1 (PRIOR ART)
FIG. 1 is an exploded view illustrating the relationship between a locking member and a main gun body of a prior art design of gun that has the magazine mounted in front of the grip.
Figure 2:
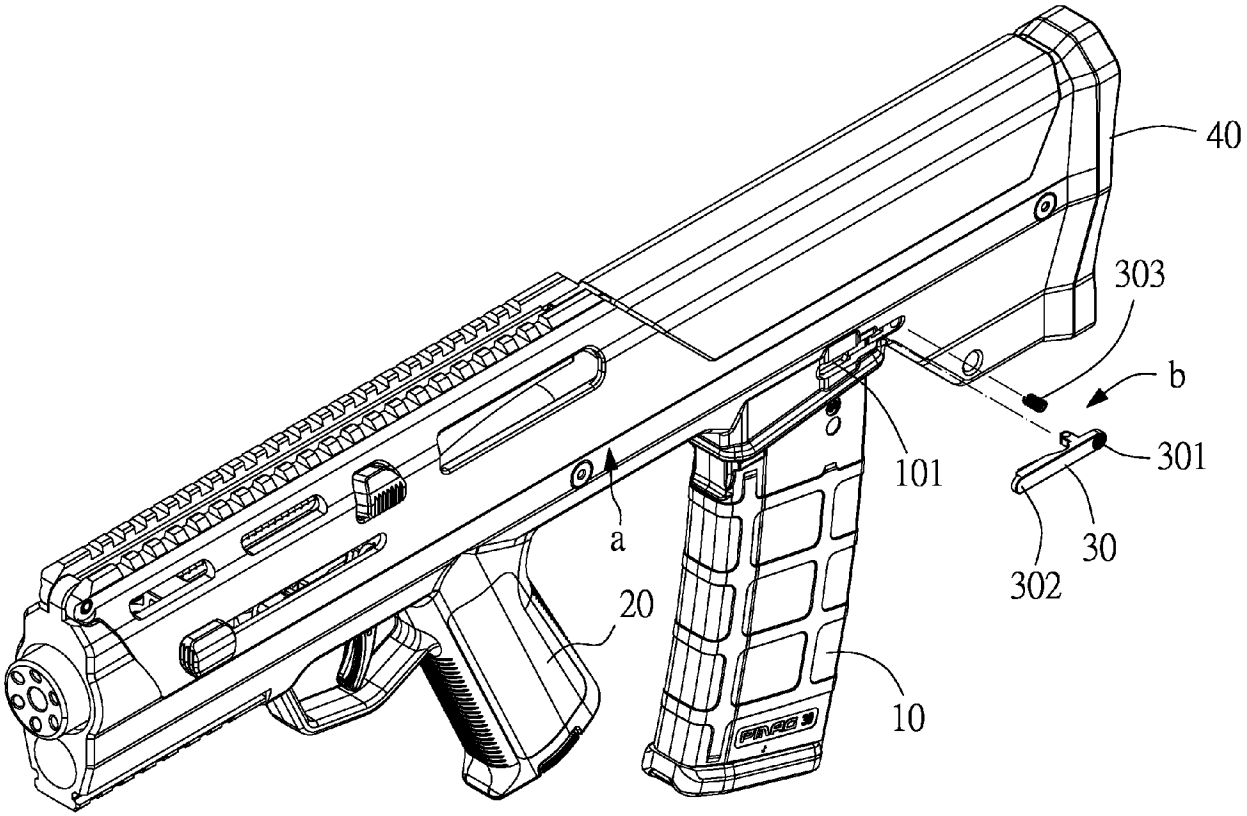
FIG. 2 (PRIOR ART)
FIG. 2 is an exploded view illustrating the relationship between a locking member and a main gun body of another prior art design of gun that has the magazine mounted behind the grip.
Figure 3:
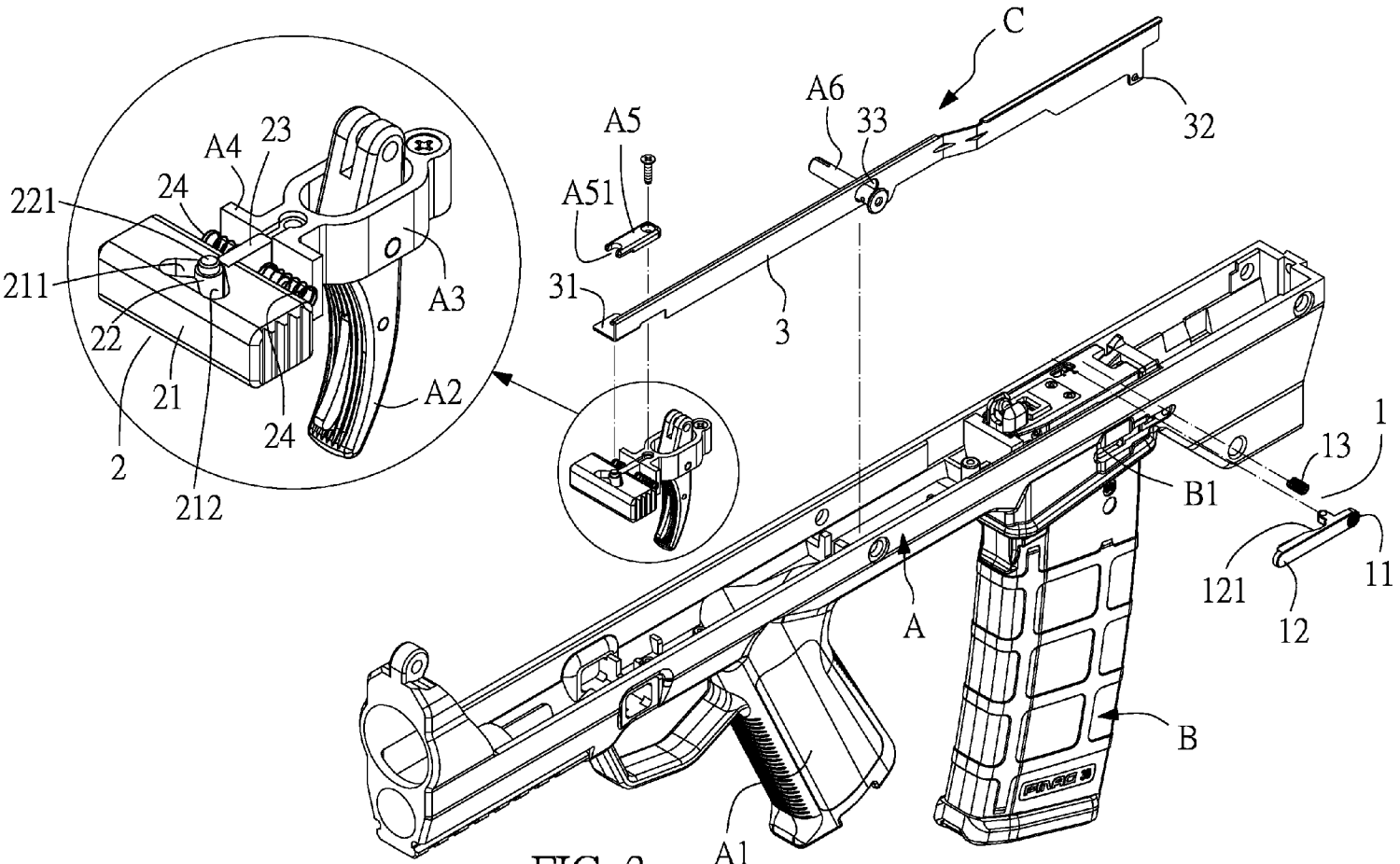
FIG. 3 is an exploded view of a magazine locking structure used in a gun in accordance with the present invention.
Figure 4:
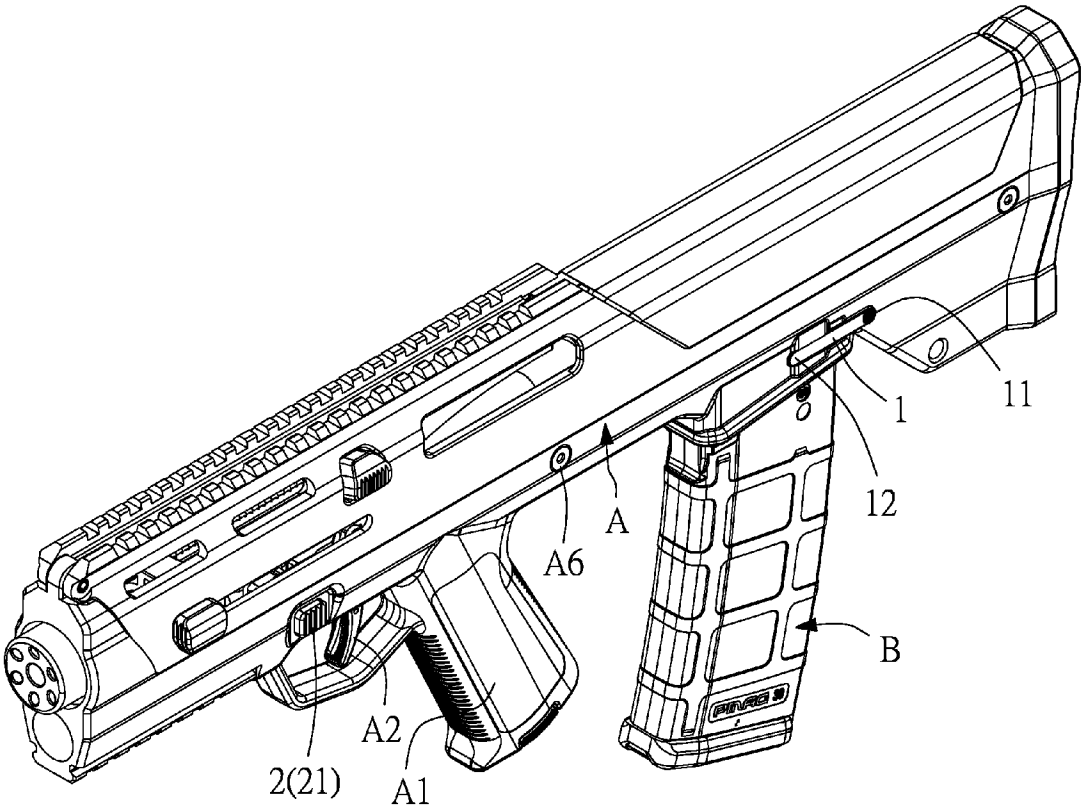
FIG. 4 is an oblique elevational view of the gun shown in FIG. 3.

Referring to FIG. 3, a magazine locking structure C in accordance with the present invention is shown installed in a gun. The gun comprises a main gun body A and a magazine B. The main gun body A comprises a grip A1, a trigger A2 disposed at a front side relative to the grip A1 (see FIG. 4), a trigger holder A3 disposed around the top side of the grip A1 (see FIG. 3), a front block A4 fixedly located at the front side of the trigger holder A3, and a cover plate A5 connected to the top side of the front block A4. The cover plate A5 defines a notch A51 at the front side thereof. The magazine B is mounted in the main gun body A at a rear side relative to the grip A1, defining a retaining groove B1. Further, the magazine locking structure C comprises a locking member 1, a spring-loaded button set 2, and a link 3.

Figure 9:
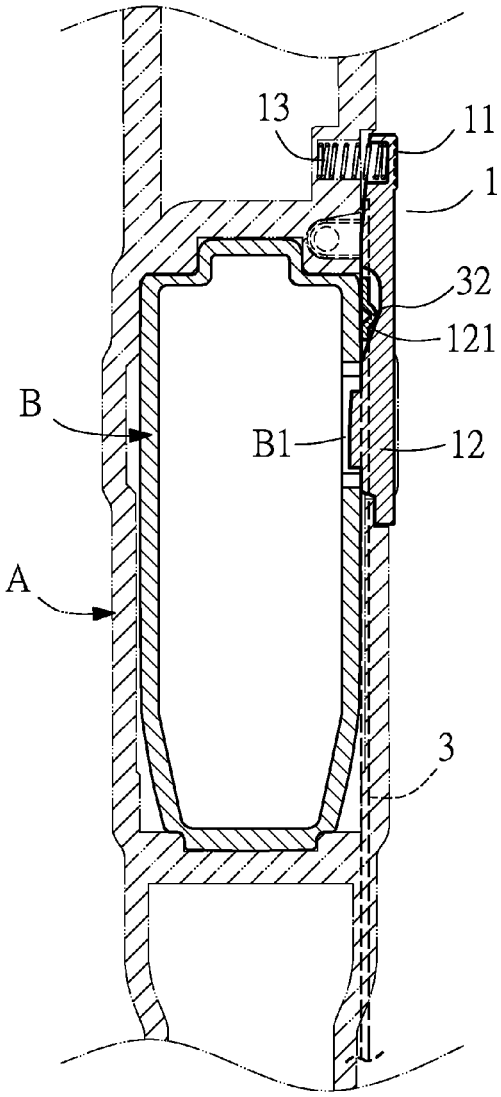
FIG. 9 is a schematic top view illustrating the status of the locking member prior to movement of the link.

The locking member 1 (see FIG. 3) is mounted at one lateral side of the main gun body A adjacent to the magazine B, having two opposite ends thereof respectively terminating in a press rod portion 11 and a locking rod portion 12. The press rod portion 11 has its inner side connected to and supported on a first spring member 13. Thus, when the press rod portion 11 is not pressed, the locking rod portion 12 is held in the retaining groove B1 of the magazine B (see FIG. 9) to lock the magazine B to the main gun body A. On the contrary, when the user presses the press rod portion 11 (see FIG. 10), the locking rod portion 12 is forced out of the retaining groove B1 to unlock the magazine B from the main gun body A, allowing removal of the magazine B from the main gun body A.

Figure 5:
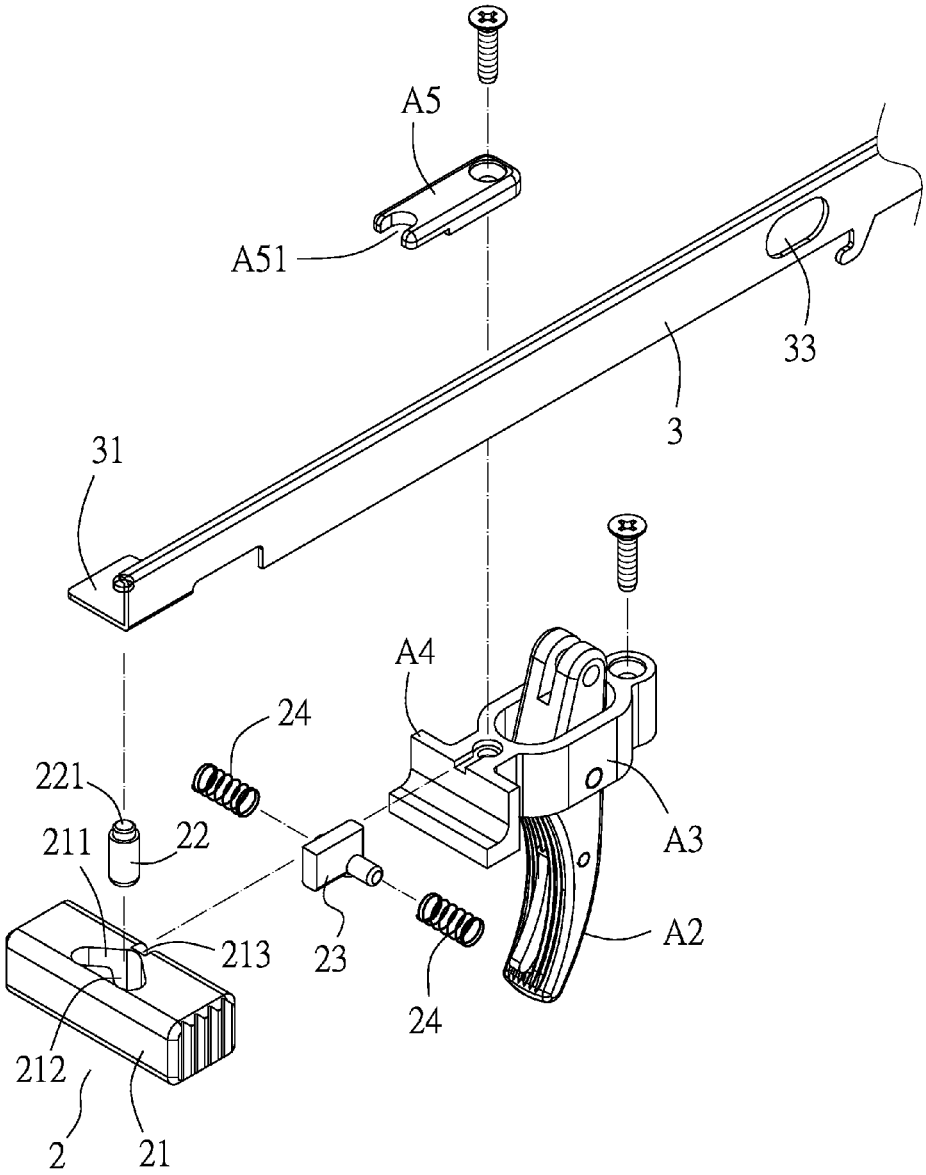
FIG. 5 is an exploded view of the spring-loaded button set and link of the magazine locking structure in accordance with the present invention.
Figure 6:
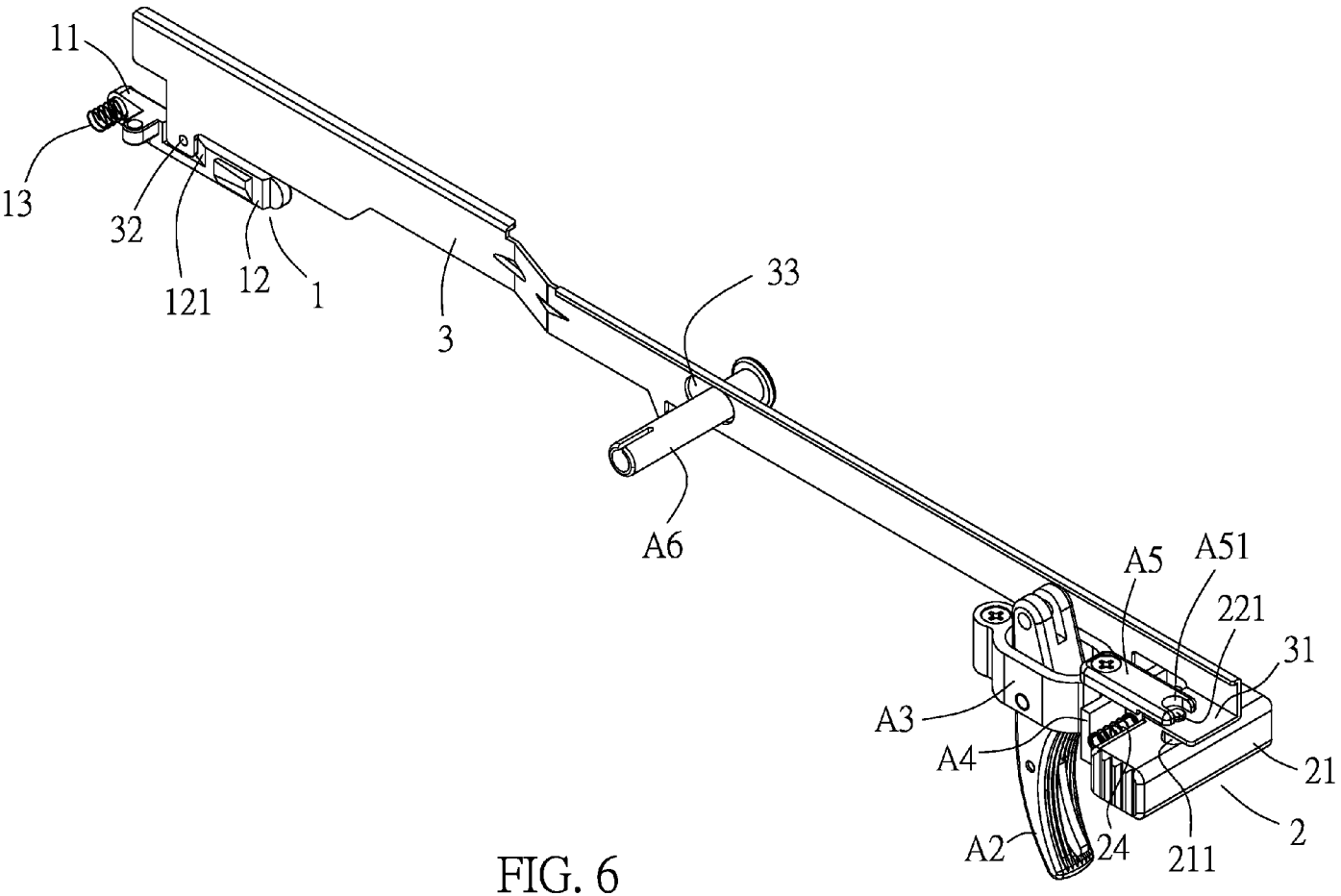
FIG. 6 is an elevational assembly view of the magazine locking structure in accordance with the present invention.
Figure 7:
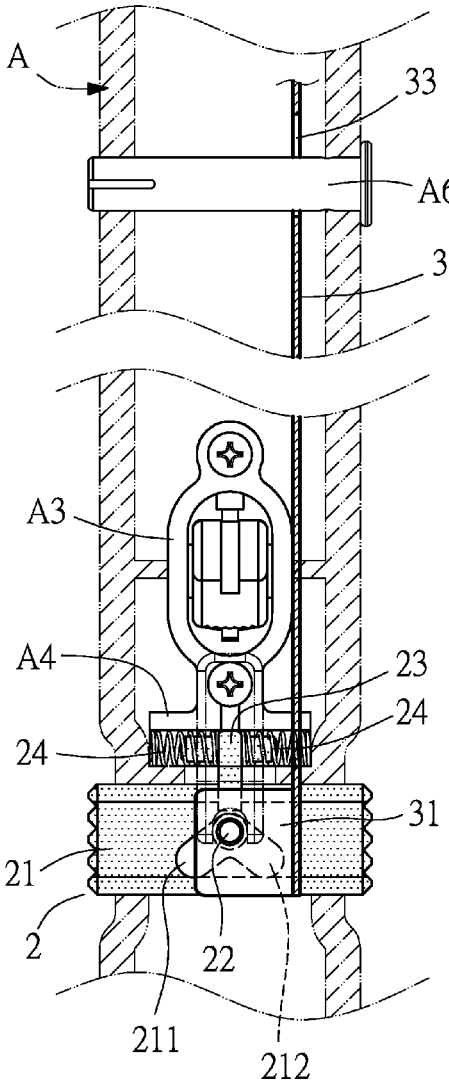
FIG. 7 is a schematic drawing of the present invention illustrating the status of the spring-loaded button set prior to pressing of the press block.

The spring-loaded button set 2 (see FIG. 3) is mounted within the main gun body A at a front side relative to the grip A1, comprising a press block 21, an actuation rod 22, a push block 23, and two second spring members 24 (see FIG. 5). The press block 21 is transversely movably inserted through the main gun body A, i.e., the opposing left and right ends of the press block 21 respectively protrude over the opposing left and right sides of the main gun body A (see FIG. 7) and the press block 21 can be pushed leftward or rightward relative to the main gun body A. Further, the press block 21 is disposed at a front side relative to the trigger holder A3 (see FIG. 5), defining an oblique left slot 211 and an oblique right slot 212 disposed in a symmetric manner and linked to each other and a locating groove 213 located at a rear side thereof. The actuation rod 22 is pivotally mounted in the press block 21. When the press block 21 is not pressed (see FIG. 7), the actuation rod 22 is accommodated between the oblique left slot 211 and the oblique right slot 212; when the user pushes the press block 21 leftward (see FIG. 8), the actuation rod 22 will be forced into the oblique right slot 212; on the contrary, when the user pushes the press block 21 rightward, the actuation rod 22 will be forced into the oblique left slot 211 (not illustrated). Further, the actuation rod 22 comprises a top extension portion 221 protruding over the top side of the press block 21 and engaged into the notch A51 of the cover plate A5 (see FIG. 6). Further, the push block 23 is supported on the front block A4 below the cover plate A5, having its front end tightly secured to the locating groove 213 of the press block 21. The two second spring members 24 are respectively mounted at opposing left side and right side of the push block 23. After the press block 21 having been pushed leftward or rightward, the elastic potential energy of the corresponding second spring member 24 immediately pushes the press block 21 back to its former position where the actuation rod 22 is kept in between the oblique left slot 211 and the oblique right slot 212.

Figure 8:
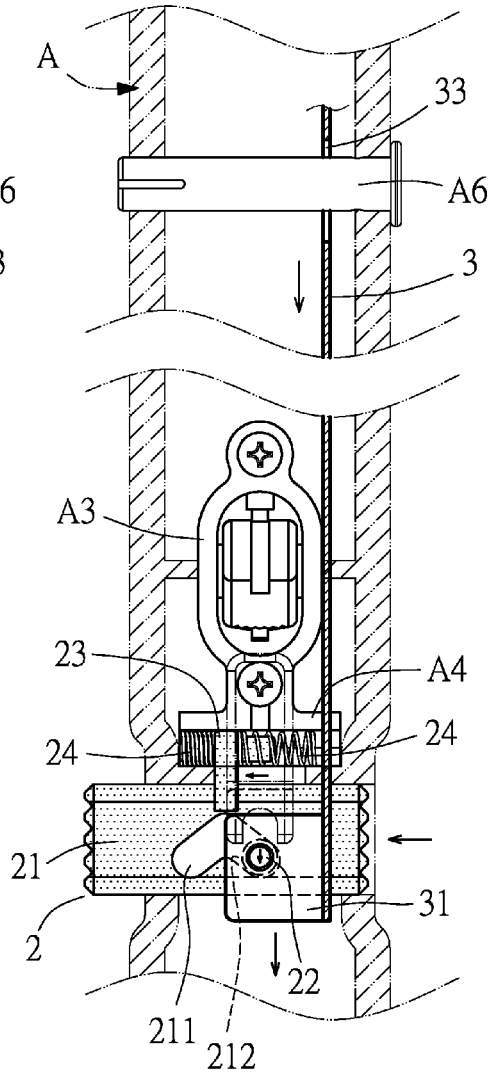
FIG. 8 corresponds to FIG. 7, illustrating the press block of the spring-loaded button set pushed leftward.

The link 3 (see FIG. 3) is mounted within the main gun body A, comprising a side lug 31 transversely extended from one side of a front end thereof, a rear lug 32 downwardly extended from an opposing rear end thereof, and an oblong horizontal slot 33 located at a middle part thereof and horizontally slidably coupled to a guide rod A6 of the main gun body A. The side lug 31 is fixedly connected to the top extension portion 221 of the actuation rod 22, enabling the link 3 to be moved synchronously with the actuation rod 22 when the user pushes the press block 21 leftward or rightward. The rear lug 32 is disposed at an inner side relative to the locking member 1 (see FIG. 9). When the user pushes the press block 21 leftward or rightward to move the actuation rod 22 into the oblique left slot 211 or oblique right slot 212 (FIG. 8 illustrates the actuation rod 22 moved into the oblique right slot 212), the link 3 is carried forward by the actuation rod 22, causing the rear lug 32 to push the locking rod portion 12 of the locking member 1 out of the retaining groove B1 of the magazine B (see FIG. 10) for allowing removal of the magazine B from the main gun body A. When the external force is released from the press block 21, the actuation rod 22 is immediately returned to the position between the oblique left slot 211 or oblique right slot 212 (see FIG. 7) to carry the link 3 backward, thereby causing the locking rod portion 12 of the locking member 1 to be engaged into the retaining groove B1 of the magazine B to lock the magazine B to the main gun body A again (see FIG. 9).

Figure 10:
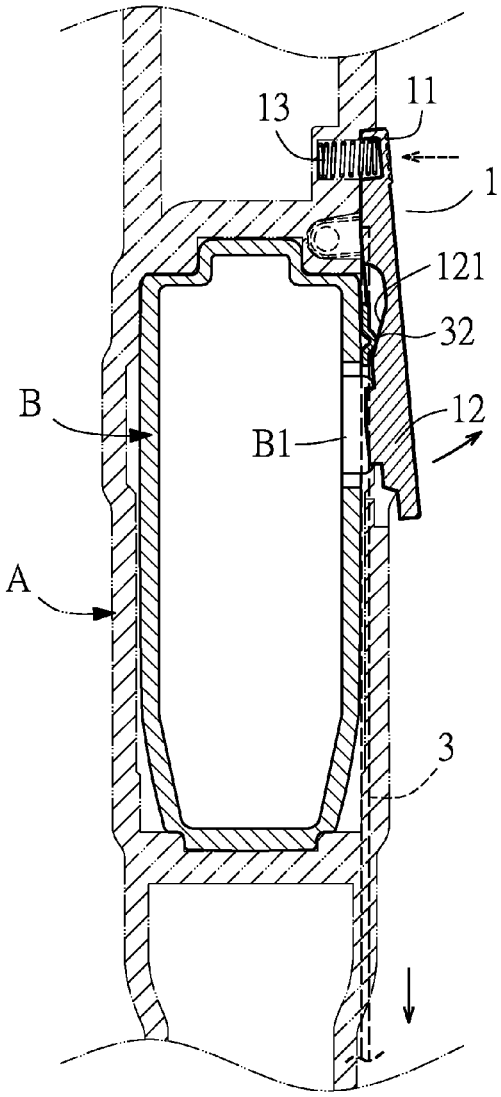
FIG. 10 corresponds to FIG. 9, illustrating the locking member moved after displacement of the link.

Further, the locking member 1 comprises a beveled guide edge 121 located at an inner side of the locking rod portion 12 and abutted against the rear lug 32 so that the locking rod portion 12 of the locking member 1 can be pushed out of the retaining groove B1 of the magazine B by the rear lug 32 when the link 3 forward (see FIG. 10).

As stated above, when going to dismount the magazine B, the user can directly press the press rod portion 11 of the locking member 1, enabling the locking rod portion 12 to be forced out of the retaining groove B1 of the magazine B. Alternatively, the user can push the press block 21 of the spring-loaded button set 2 to move the actuation rod 22, the push block 23 and the second spring members 24 and to further shift the link 3 forward (see FIG. 8) or backward. When the link 3 is moved forward (see FIG. 8), the rear lug 32 will push the locking rod portion 12 of the locking member 1 in direction away from the retaining groove B1 of the magazine B (see FIG. 10), thereby unlocking the magazine B from the main gun body A, i.e., the user can operate the spring-loaded button set 2 to drive the link 3 to move locking member 1 in direction away from the magazine B, thereby unlocking the magazine B from the main gun body A. Therefore, the invention effectively eliminates the drawbacks of the conventional designs.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A magazine locking structure mounted in a gun comprising a main gun body equipped with a grip and a magazine detachably mounted in said main gun body at a rear side relative to said grip, said magazine comprising a retaining groove, said magazine locking structure comprising a locking member mounted at one lateral side of said main gun body adjacent to said magazine and a first spring member supporting said locking member, said locking member having two opposite ends thereof respectively terminating in a press rod portion and a locking rod portion, said press rod portion having an inner side thereof connected to and supported on said first spring member in such a manner that said locking rod portion is held in said retaining groove of said magazine to lock said magazine to said main gun body when said press rod portion receives no pressure and, said locking rod portion is forced out of said retaining groove of said magazine to unlock said magazine from said main gun body when said press rod portion is pressed by an external force, wherein:

said magazine locking structure further comprises a spring-loaded button set and a link, said spring-loaded button set and said link being mounted within said main gun body, said spring-loaded button set comprising a press block and an actuation rod, said press block being transversely inserted through said main gun body and alternatively movable leftward and rightward relative to said main gun body, said actuation rod being mounted in said press block and movable by said press block to carry said link alternatively forward and backward, said link comprising a rear lug located at a rear side thereof and abutted at an inner side of said locking member, said rear lug being adapted to force said locking rod portion of said locking member out of said retaining groove of said magazine and to further unlock said magazine from said main gun body when said actuation rod is forced to carry said link forward, and to let the locking rod portion of said locking member be forced into said retaining groove of said magazine and to further lock said magazine to said main gun body when said actuation rod is forced to carry said link backward.

2. The magazine locking structure as claimed in claim 1, wherein said spring-loaded button set is mounted in said main gun body at a front side relative to said grip; said press block comprises an oblique left slot and an oblique right slot disposed in a symmetric manner and linked to each other; said actuation rod is accommodated in between said oblique left slot and said oblique right slot when said press block receives zero external pressure, and is forced into said oblique right slot when said press block is pushed leftward relative to said main gun body by an external force, or into said oblique left slot when said press block is pushed rightward relative to said main gun body by an external force.

3. The magazine locking structure as claimed in claim 2, wherein said spring-loaded button set further comprises a push block and two second spring members, said push block having a front end thereof fixedly connected to said press block, said two second spring members being respectively mounted at opposing left side and right side of said push block and adapted to push said press block back to the position where said actuation rod is kept in between said oblique left slot and said oblique right slot after said press block having been pushed leftward or rightward relative to said main gun body.

4. The magazine locking structure as claimed in claim 3, wherein said actuation rod comprises a top extension portion upwardly extended out of said press block; said link further comprises a side lug transversely extended from one side of a front end thereof and fixedly connected to said top extension portion of said actuation rod.

5. The magazine locking structure as claimed in claim 4, wherein said link further comprises an oblong horizontal slot located at a middle part thereof and horizontally slidably coupled to a guide rod of said main gun body.

6. The magazine locking structure as claimed in claim 5, wherein said press block further comprises a locating groove located at a rear side thereof said push block has a front end thereof fixedly connected to said locating groove of said press block.

7. The magazine locking structure as claimed in claim 6, wherein said locking member further comprises a beveled guide edge located at an inner side of said locking rod portion and abutted against said rear lug of said link so that said locking rod portion of said locking member is movable out of said retaining groove of said magazine by said rear lug when said actuation rod carry said link forward.

* * * * *